US006275192B1

(12) United States Patent
Kim

(10) Patent No.: US 6,275,192 B1
(45) Date of Patent: Aug. 14, 2001

(54) PLANAR ANTENNA

(75) Inventor: Young-eil Kim, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/749,915

(22) Filed: Dec. 29, 2000

(30) Foreign Application Priority Data

May 31, 2000 (KR) ..... 00-29567

(51) Int. Cl.[7] ..... H01Q 1/38

(52) U.S. Cl. ..... 343/700 MS; 343/829; 343/831

(58) Field of Search ..... 343/700 MS, 829, 343/831, 846, 848; H01Q 1/38

(56) References Cited

U.S. PATENT DOCUMENTS 5,526,003 * 6/1996 Ogawa et al. ..... 343/700 MS
5,828,340 * 10/1998 Johnson ..... 343/700 MS
6,043,786 * 3/2000 Vannatta et al. ..... 343/770
6,133,880 * 10/2000 Grangeat et al. ..... 343/700 MS
6,133,881 * 10/2000 Kushihi et al. ..... 343/700 MS
6,195,049 * 2/2001 Kim et al. ..... 343/700 MS
6,211,825 * 4/2001 Deng ..... 343/700 MS

* cited by examiner

*Primary Examiner*—Tho G. Phan
(74) *Attorney, Agent, or Firm*—Sughrue, Mion, Zinn, Macpeak & Seas, PLLC

(57) ABSTRACT

A small planar antenna combined with a printed circuit board (PCB). The planar antenna includes: a dielectric layer with a predetermined thickness; first and second ground layers formed on top and bottom surfaces of the dielectric layer, respectively, corresponding to each other; and a first antenna unit which extends from a side of each of the respective first and the second ground layers, for radiating a first polarized wave with the application of current. A second antenna unit extends from a side of each of the respective first and second ground layers, for radiating a second polarized wave orthogonal to the first polarized wave with the application of current. A feeding stripline is installed between the first and second antenna units, in the dielectric layer, for applying the current to the first and second antenna units, wherein the first and second polarized waves can be separately radiated.

18 Claims, 9 Drawing Sheets

PLANAR ANTENNA

BACKGROUND OF THE INVENTION

1. Field of the Invention

The present invention relates to a planar antenna and, more particularly, to a small planar antenna combined with a printed circuit board.

2. Description of the Related Art

Antennas are classified into linearly (vertical or horizontal) polarized wave antennas, and circularly polarized wave antennas according to the polarization properties of incident electromagnetic waves. The linearly polarized wave is transmitted along a plane and thus it can be lost. In contrast, the circularly polarized wave is transmitted through two planes of the same size that cross each other, and interference from other devices can be eliminated because the circular polarization antenna is able to transmit two polarized components, the horizontally and vertically polarized waves. Thus, even if the position and direction of a transmission antenna or reception antenna changes, both transmission and reception of waves are possible, and there is an advantage of omnidirectional sensitivity.

Recently, the advance in wireless data communications has increased the need for the bluetooth PICO Net (BPN) antenna which couples personal computers (PCs), notebook PCs, printers, or mobile phones through a wireless network. The BPN antenna is a circular polarization antenna which has a consistent transmission/reception sensitivity in every direction, with non-directional properties, or an antenna capable of radiating a plurality of polarized waves.

On the other hand, a conventional circular polarization antenna includes an x-directional antenna arranged in the x-direction and an x-directional antenna which is arranged perpendicular to the x-directional antenna. Both the x-directional antenna and the y-directional antenna are half wavelength dipole antennas. Referring to FIG. 1, the wavelength of an x-directional horizontally polarized wave 1 radiated from the x-directional antenna has a phase difference of 90° with respect to the wavelength of a y-directional vertically polarized wave 2 radiated from the y-directional antenna. Thus, circularly polarized waves can be obtained by powering the x-directional antenna and the y-directional antenna in sequence. However, a drawback of the conventional circular polarization antenna lies in that to provide the x- and y-directional antennas with the phase difference of 90°, a phase shifter for delaying a radio frequency (RF) signal fed from an RF signal module of the antenna is needed. In addition, the complicated structure of the antenna hinders production of a small antenna.

SUMMARY OF THE INVENTION

To solve the above problems, it is an objective of the present invention to provide a planar antenna with consistent transmission and reception sensitivity in every direction, which can be adapted in a small device.

The objective of the present invention is achieved by a planar substrate comprising: a dielectric layer with a predetermined thickness; a first ground layer formed on a top surface of the dielectric layer; and a second ground layer formed on a bottom surface of the dielectric layer, with the first ground layer and the second ground layer corresponding to each other. A first antenna unit is provided which extends from a side of the first ground layer and a side of the second ground layer. The first antenna unit has a predetermined pattern that radiates a first polarized wave with an application of current. A second antenna unit is provided which extends from a side of the first ground layer and a side of the second ground layer. The second antenna unit has a predetermined pattern that radiates a second polarized wave orthogonal to the first polarized wave with the application of current. A feeding stripline is installed between the first and second antenna units, in the dielectric layer, for applying current to the first and second antenna units, wherein the first and second polarized waves can be separately radiated from the first and second antenna units, respectively.

BRIEF DESCRIPTION OF THE DRAWINGS

The above objective and advantages of the present invention will become more apparent by describing in detail preferred embodiments thereof with reference to the attached drawings, in which.

DETAILED DESCRIPTION OF THE PREFERRED EMBODIMENTS

Figure 2:
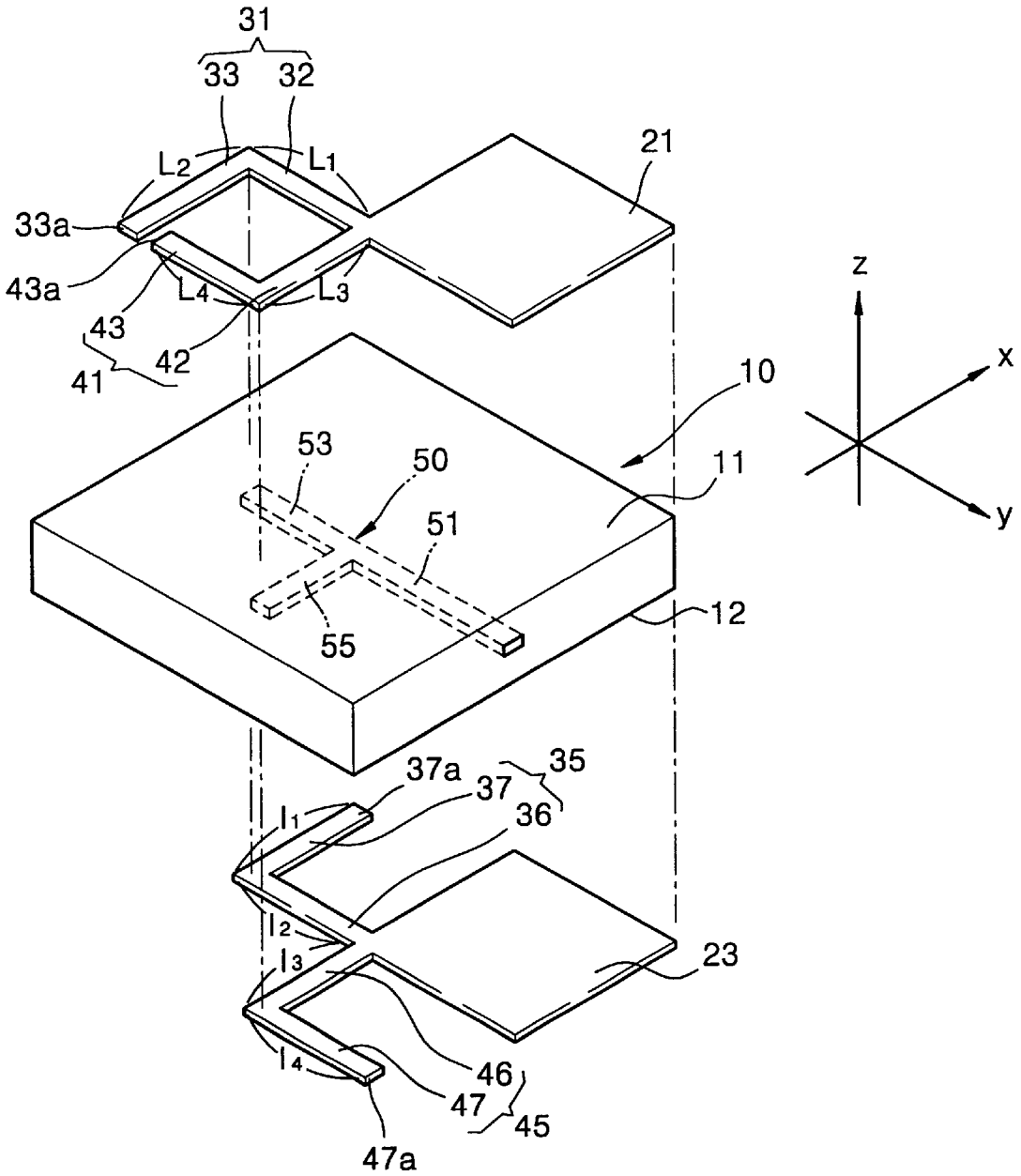
FIG. 2 is an exploded perspective view of a first embodiment of a planar antenna according to the present invention.
Figure 3:
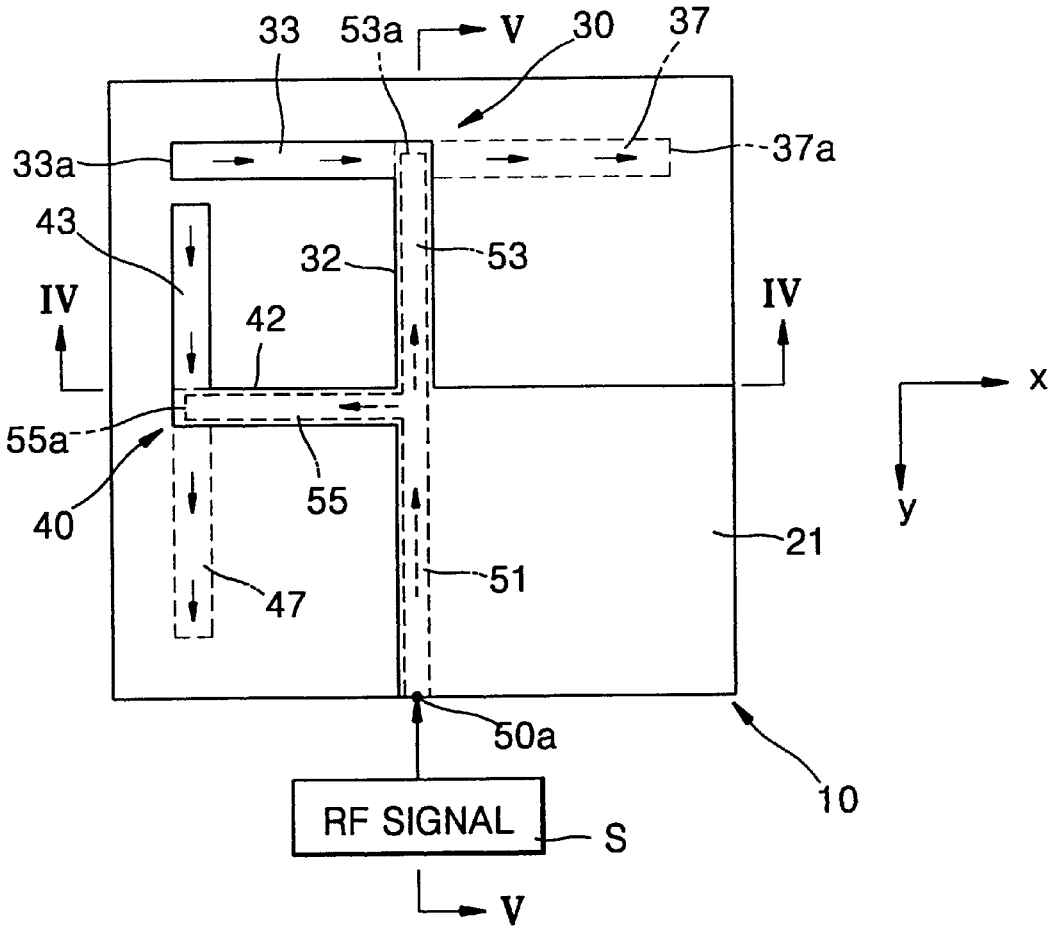
FIG. 3 is a plan view of FIG. 2.

Referring to FIGS. 2 and 3, a first embodiment of a planar antenna according to the present invention includes a planar dielectric layer 10 with a predetermined thickness, a first ground layer 21 and a second ground layer 23 disposed above and below the dielectric layer 10, respectively, a first antenna unit 30 and a second antenna unit 40 that extend from the first and second ground layers 21 and 23 in a direction with a predetermined pattern, and a feeding stripline 50 disposed between the first and second antenna units 30 and 40 to apply a predetermined voltage to the first and second antenna units 30 and 40.

Preferably, a printed circuit board (PCB) of a device that adopts the planar antenna according to the present invention may be used as the dielectric layer 10. In other words, the planar antenna can be combined with a PCB. In this case, the first ground layer 21 is formed on a top surface 11 of the PCB, and the second ground layer 23 is formed on a bottom surface 12 of the PCB.

The first ground layer 21 is mounted on the dielectric layer 10 with a predetermined width to cover a predetermined portion of the top surface 11. The second ground layer 23 is mounted below the dielectric layer 10 with a predetermined width, corresponding to the first ground layer 21, to cover a predetermined portion of the bottom surface 12. It is preferable that the dielectric layer 10 is thin enough to transmit power between the first and second ground layers 21 and 23 by a coupling effect.

The first antenna unit 30, which radiates a predetermined first polarized wave, includes a first upper radiation pattern 31 formed with a predetermined pattern on the top surface 11 of the dielectric layer 10, and a first lower radiation pattern 35 formed with a predetermined pattern on the bottom surface 12, to be symmetrical with respect to the first upper radiation pattern 31. The first upper radiation pattern 31 includes a first upper stub line 32 and a first upper radiation portion 33. The first upper stub line 32 has a predetermined width and extends a predetermined length L1 from the edge of the first ground layer 21 in the -y-direction. Preferably, the length L1 is equal to $\lambda/4$. The first upper radiation portion 33 extends in the -x-direction from the end of the first upper stub line 32. As a result, the first upper radiation portion 33 and the first upper stub line 32 are arranged perpendicular to each other on the x-y plane. The first upper radiation portion 33 radiates power received in the form of current into the air or space in the form of wave energy, so that an image effect occurs at the end 33*a*. In the present embodiment, the length L2 of the first upper radiation portion 33 is shorter than the length L1, i.e., $\lambda/4$, of the first upper stub line 32.

The first lower radiation pattern 35 has a first lower stub line 36 formed corresponding to the first upper stub line 32, and a first lower radiation portion 37, which extends from the end of the first lower stub line 36 in the x-direction. In other words, the first lower stub line 36 extends from the edge of the second ground layer 23 in the same direction and by the same length as the first upper stub line 32. The first upper radiation pattern 31 and the first lower radiation pattern 35, which are symmetrically positioned around the dielectric layer 10, i.e., above and below the same, construct a half wavelength antenna to radiate a first polarized wave 1 (See FIG. 6A) with the application of current.

The second antenna unit 40 has a pattern perpendicular to the pattern of the first antenna unit 30 and radiates a second polarized wave 2 (see FIG. 6B) perpendicular to the first polarized wave 1. The second antenna unit 40 includes a second upper radiation pattern 41 formed with a predetermined pattern on the top surface 11 of the dielectric layer 10, and a second lower radiation pattern 45 formed on the bottom surface 12 with a predetermined pattern to be symmetrical with respect to the second upper radiation pattern 41.

The second upper radiation pattern 41 has a second upper stub line 42 and a second upper radiation portion 43, which are above the top surface 11 on the same plane as that of the first ground layer 21. The second upper stub line 42 extends from the edge of the first ground layer 21 in the -x-direction perpendicular to the first upper stub line 32, and has a length L3 of $\lambda/4$. The second upper radiation portion 43 extends from the end of the second upper stub line 42 in the -y-direction. Preferably, the length L4 of the second upper radiation portion 43 is shorter than the length L3, i.e., $\lambda/4$, of the second upper stub line 42 in consideration of an image effect at an end 43*a* of the second upper radiation portion 43.

The second lower radiation pattern 45 includes a second lower stub line 46, which extends from the second ground layer 23 in the -x-direction, and a second lower radiation portion 47, which extends from the end of the second lower stub line 46 by less than $\lambda/4$ in the y-direction. The upper radiation pattern 41 and the lower radiation pattern 45 cooperatively act as a half wavelength antenna with the supply of power, and radiate the second polarized wave 2.

The feeding stripline 50, which is for applying power to the first and second antenna units 30 and 40, is embedded in the dielectric layer 10. The feeding stripline 50 has a feeding portion 51 which has a predetermined length and a feeding point 50*a* at one end, a first branch 53 that extends from the feeding portion 51 toward the opposite end of the feeding point 50*a*, and a second branch 55 diverged from the feeding portion 51. The feeding portion 51 is positioned between the first and second ground layers 21 and 23. The feeding portion 50*a* is exposed outside the dielectric layer 10 to receive power, i.e., an RF signal S, supplied from a predetermined RF frequency circuit module (not shown). The first branch 53 is positioned between the first upper and lower stub lines 32 and 36, and power is fed through its end 53*a* to the first lower radiation portion 37. The second branch 55 is positioned between the second upper and lower stub lines 42 and 46, and power is fed through its end 55*a* to the second lower radiation portion 47. The first and second branches 53 and 55 are branched from the feeding portion 51 to be perpendicular to each other on the same plane, and have the same length to the first and second lower radiation portions 37 and 47, respectively, thus a phase difference is not produced. In the present embodiment, the feeding portion 51 and the first branch 53 are arranged in a line in the y-direction, so that almost all of the power fed to the feeding portion 51 is transferred to the first branch 53. As a result, a relatively small amount of power is transferred to the second branch 55 that branches off from the feeding portion 51 perpendicularly.

The operation of the planar antenna according to the present invention, having the structure previously described, will be described with reference to FIGS. 2 through 5.

Figure 4:
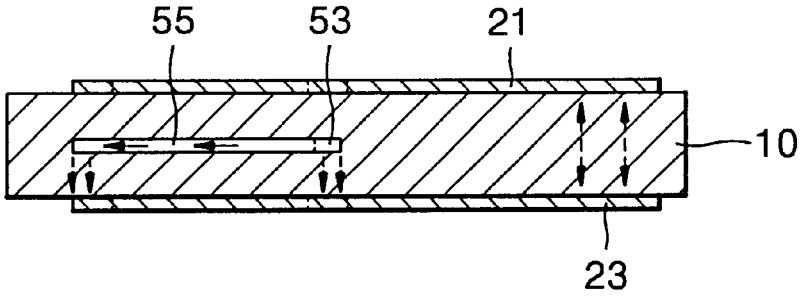
FIG. 4 is a sectional view taken along line IV—IV of FIG. 3.
Figure 5:
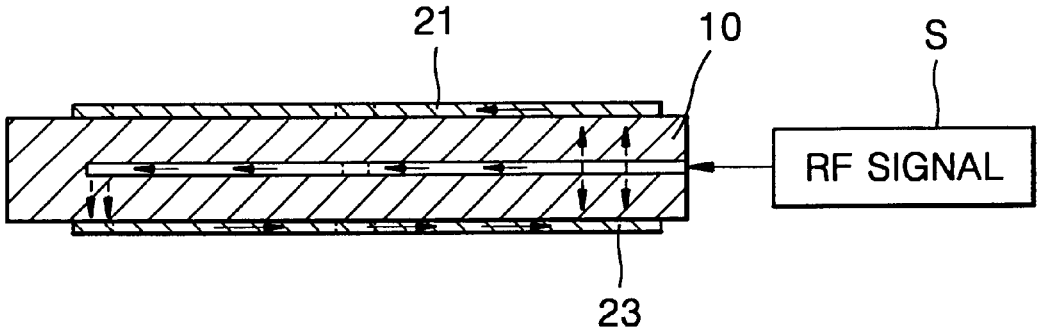
FIG. 5 is a sectional view taken along line V—V of FIG. 3.
Figure 6A:
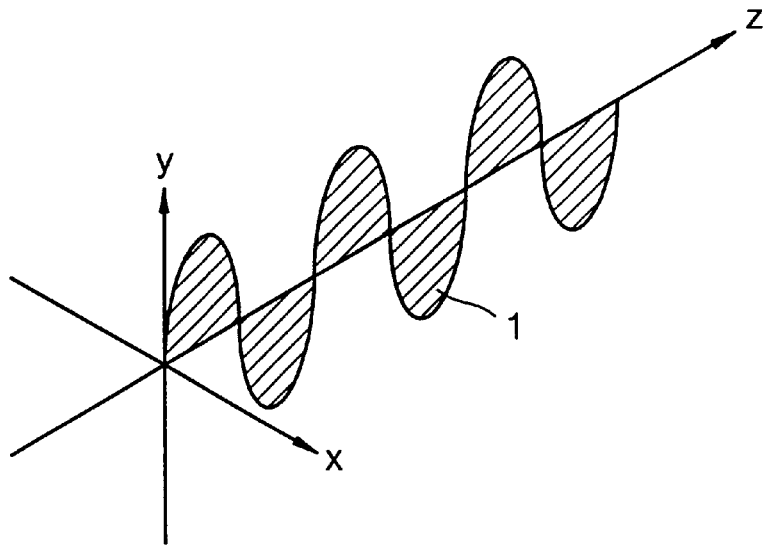
FIG. 6A illustrates the transmission of a first polarized wave through the first antenna of FIG. 3.

Power, i.e., an RF signal (S), is fed to the feeding point 50*a* of the feeding stripline 50 from a predetermined RF circuit module. The fed power is split and transferred through the first and second branches 53 and 55 via the feeding portion 51. The power fed to the first branch 53 is transferred to the first lower radiation portion 37 by a coupling effect, as shown in FIGS. 3 and 4, and radiated into the air in the form of propagation energy through conversion by the first lower radiation portion 37. Here, a portion of the power transferred to the first lower radiation portion 37 is reflected by its end 37*a*, rather than radiated through the end 37*a*, and returns to the second ground layer 23 through the first lower stub line 36. The return power is transferred to the first ground layer 21 by a coupling effect, converted to propagation energy by the first upper radiation portion 33 through the first upper stub line 32, and then radiated into the air. At this time, a portion of the power transferred to the first upper radiation portion 33 is reflected by its end 33*a*, transferred in the reverse direction to the first lower radiation portion 37, and radiated into the air. As previously mentioned, the power fed to the first branch 53 is converted to propagation energy by shuttling between the first upper and lower radiation portions 33 and 37. The first upper and lower radiation portions 33 and 37 have a function as a half-wavelength antenna, and radiate the first polarized wave 1 parallel to the y-z plane as shown in FIG. 6A.

Figure 6B:
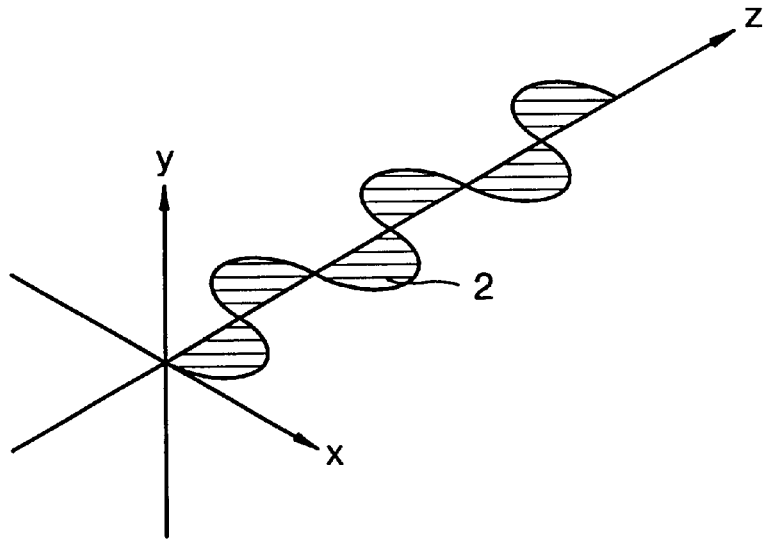
FIG. 6B illustrates the transmission of a second polarized wave through the second antenna of FIG. 3.

On the other hand, the power fed to the second branch 55 is transferred to the second lower radiation portion 47 by a coupling effect between the end of the second branch 55 and the second lower radiation portion 47, and then radiated into the air. A portion of the power transferred to the second lower radiation portion 47 is reflected by its end 47*a*, rather than radiated through the end 47*a*, and returns to the second ground layer 23. The return power is transferred to the first ground layer 21 by a coupling effect, and then radiated through the second upper stub line 42 and in turn the second upper radiation portion 43 into the air. A portion of the power transferred to the second upper radiation portion 43 is reflected by its end 43*a*, rather than radiated through the end 43*a*, is transferred back to the second lower radiation portion 47 through the first and second ground layers 21 and 23, and radiated into the air. As previously described, the power fed to the second branch 55 is radiated by shuttling between the second upper and lower radiation portions 43 and 47. The second upper and lower radiation portions 43 and 47 function as a half-wavelength antenna, and radiate the second polarized wave 2 parallel to the x-z plane, as shown in FIG. 6B.

Figure 6C:
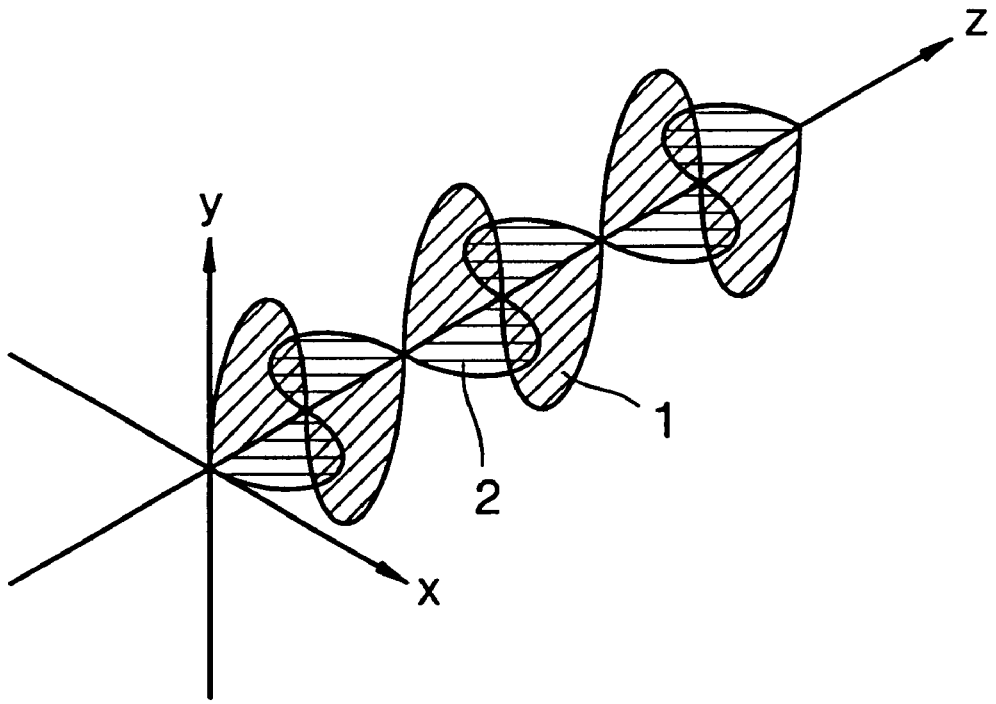
FIG. 6C is a schematic view illustrating the combination of the first and second polarized waves illustrated in FIGS. 6A and 6B.

The power fed to the second branch 55 is less than that fed to the first branch 53, so that the second polarized wave 2 is less powerful than the first polarized wave 1. However, because the first and second branches 53 and 55 have the same length, referring to FIG. 6C, the first and second polarized waves 1 and 2 are simultaneously radiated. Thus, the fist and second polarized waves 1 and 2 have no phase difference, and are radiated in the same direction orthogonal to each other with different amplitudes. The pattern of propagation of the waves seems like that from two orthogonal dipole antennas, enabling double orthogonal polarized waves to propagate.

Figure 7:
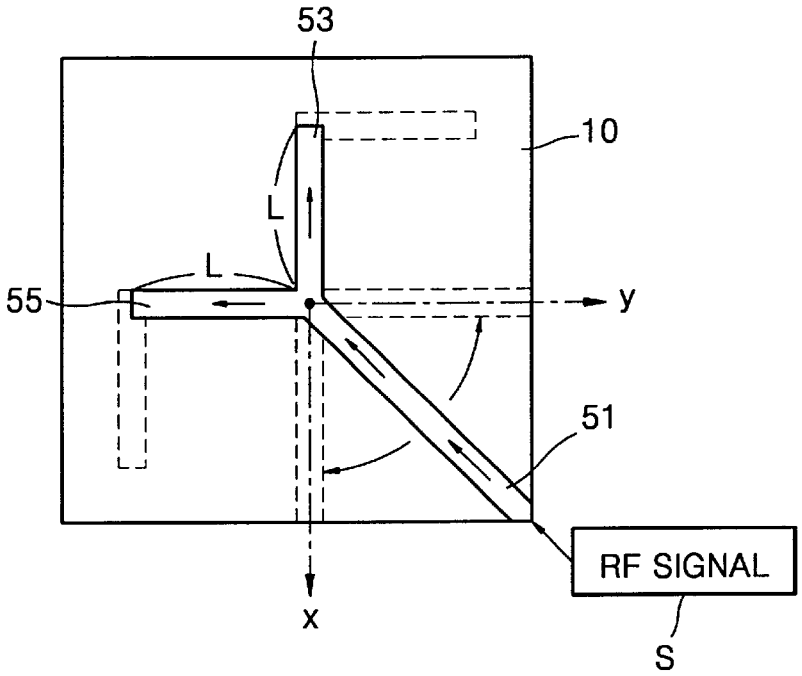
FIG. 7 is a schematic plan view showing another example of the feeding stripline of the planar antenna according to the present invention.

FIG. 7 shows another example of the feeding stripline of the planar antenna previously described. Referring to FIG. 7, the different feature of this feeding stripline is that the two orthogonal branches 53 and 55 are split from the feeding portion 51 at the same angle. In this case, the RF signal S fed to the feeding portion 51 is split for the first and second branches 53 and 55 with the same power.

Figure 8:
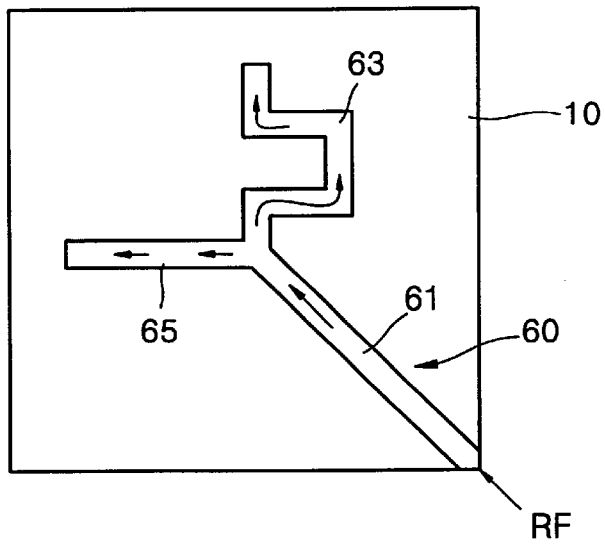
FIG. 8 is a schematic plan view showing still another example of the feeding stripline of the planar antenna according to the present invention.

In order to enable a circular polarized wave to radiate from an antenna, the feeding stripline 60 is provided with a pattern, as shown in FIG. 8, such that the first and second branches 63 and 65 diverging from the feeding portion 61 at the same angle have different lengths. Because the first and second branches 63 and 65 are split at the same angle from the feeding portion 61, the power fed to each of the first and second branches 63 and 65 through the feeding portion 61 is the same, and orthogonal polarized waves can be radiated. Also, the longer length of the first branch 63 enables feeding to the first antenna unit 30 (see of FIG. 3) through the first branch 63 to be carried out with a phase difference of 90° with respect to feeding to the second antenna unit 40 through the second branch 65. It is contemplated that the feeding portion 61 is located between a first position, which is on an extension of the first branch 63 close to and perpendicular to the second branch 65, and a second position which is on the extension of the second branch 65 close to and perpendicular to the first branch 63. The shape of pattern of the first branch 63 is not limited to that shown in FIG. 8, and any shape of pattern that is able to cause the phase difference of 90° is possible for the first branch 63.

Figure 1:
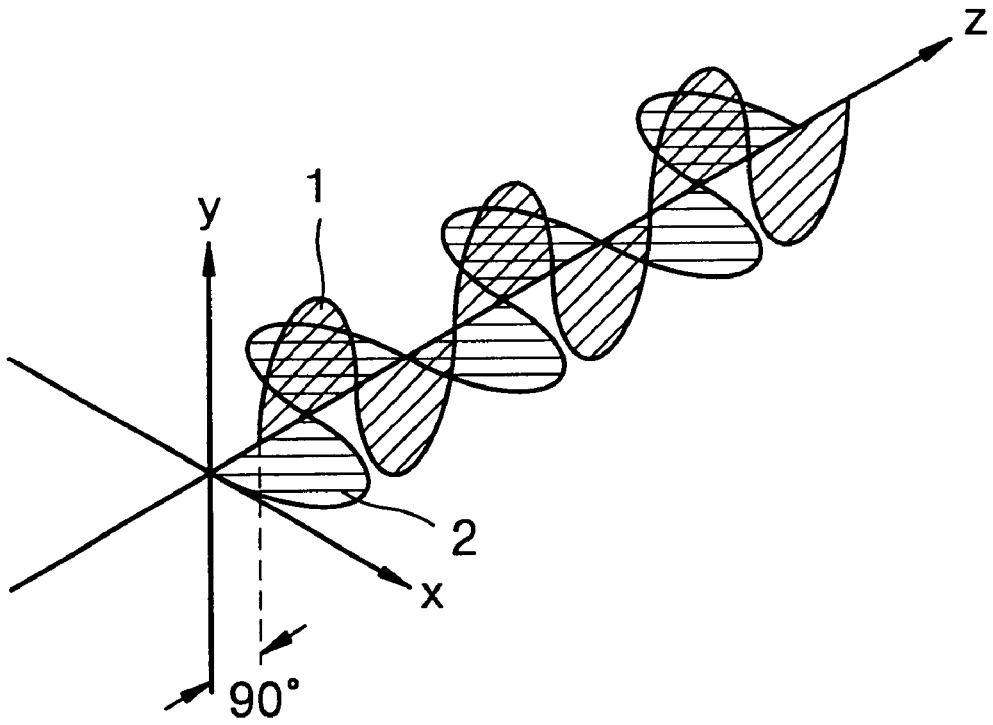
FIG. 1 illustrates the transmission of two polarized waves perpendicular to each other with a phase difference of 90°.

As previously described, the difference in length between the first and second branches 63 and 65 causes a phase difference of 90° in supplying power to both the first and second antenna units 30 and 40. Thus, as shown in FIGS. 1 and 3, the first and second polarized waves 1 and 2 are radiated through the first and second antenna units 30 and 40 with a phase difference of 90°, enabling a circular polarized wave to be realized. As a result, the planar antenna can have a consistent sensitivity in all directions, and it is easy to reduce the size of the planar antenna. In addition, by just forming the feeding stripline 60 with a predetermined pattern, without need for an additional delay element, there is the effect of a delay in feeding to the two antenna units. The circular polarized wave is divided into a left-handed polarized wave and a right-handed polarized wave according to the rotation direction of the electric field lines. Depending on which of the first and second branches 63 and 65 is designed to be longer than the other to cause the delay of feeding, the circular polarized wave radiated through the first and second antenna units 30 and 40 is determined to be a left-handed or right-handed circularly polarized wave. Therefore, various types of antennas capable of radiating a desired polarized wave can be manufactured by appropriately adjusting the lengths of the first and second branches 63 and 65 according to the type of products that adopt antennas.

Figure 9:
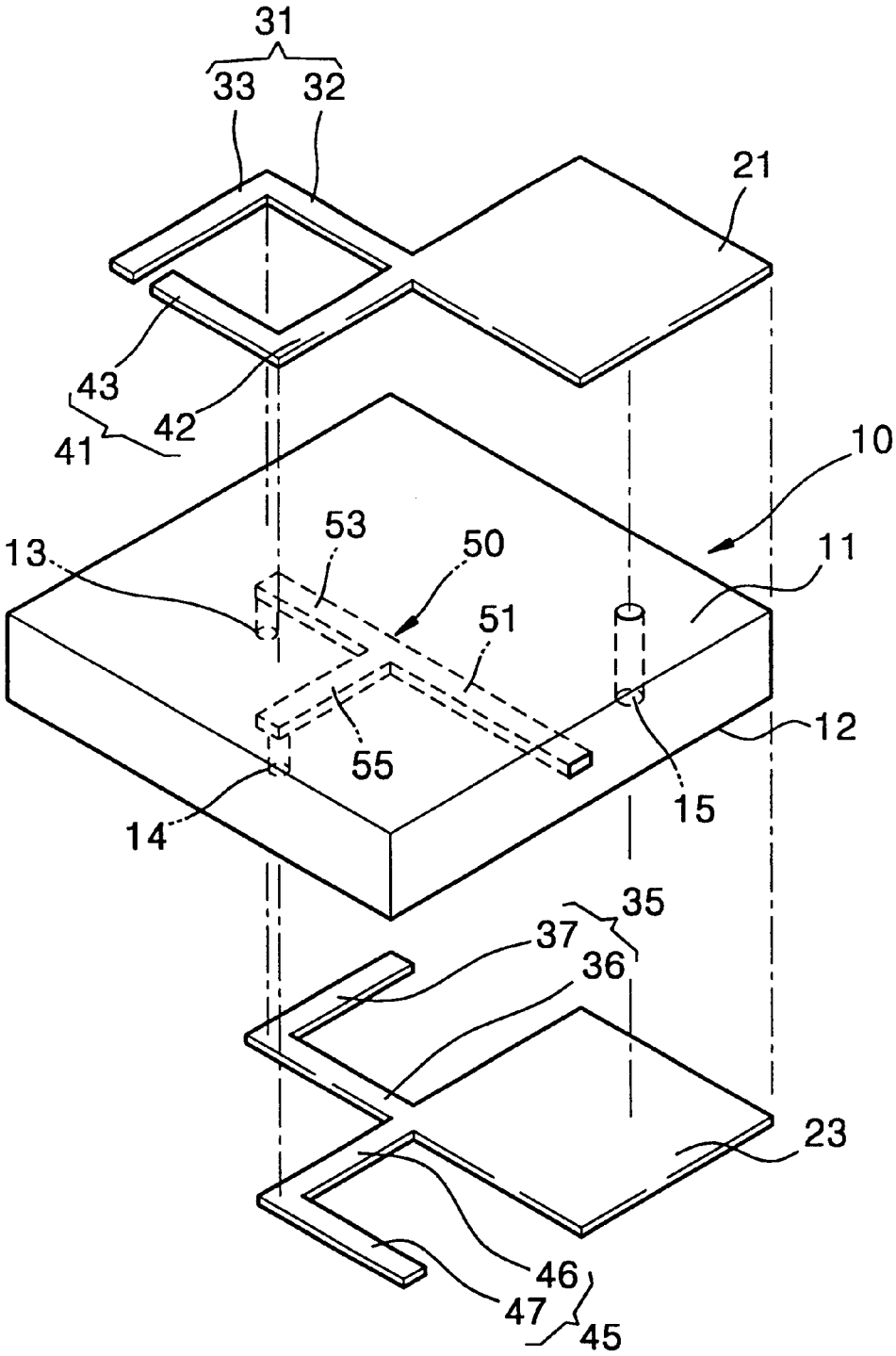
FIG. 9 is an exploded perspective view of a second embodiment of the planar antenna according to the present invention.

FIG. 9 is an exploded perspective view of a second embodiment of the planar antenna according to the present invention. In FIG. 9, like reference numerals are used to refer to like elements of FIG. 2.

Referring to FIG. 9, the dielectric layer 10 has a first via hole 13 for applying current via the end of the first branch 53 to the first lower radiation pattern 35, and a second via hole 14 for applying current via the end of the second branch 55 to the second lower radiation pattern 45. The first and second via holes 13 and 14 are provided for a feeding efficiency that is higher than that provided by a coupling effect, and the first and second via holes 13 and 14 are filled with a conductive material. The first via hole 13 electrically contacts the first lower radiation portion 37 and the first lower stub line 36 through the end of the first branch 53, and the second via hole 14 electrically contacts the second lower radiation portion 47 and the second lower stub line 46 through the end of the second branch 55.

The dielectric layer 10 is further provided with a return via hole 15 drilled through the top and bottom surfaces 11 and 12. The return via hole 15 allows for direct return of power between the first and second ground layers 21 and 23, and is filled with a conductive material. A plurality of return via holes 15 may be provided, all of which correspond to the first and second ground layers 21 and 23.

Figure 10:
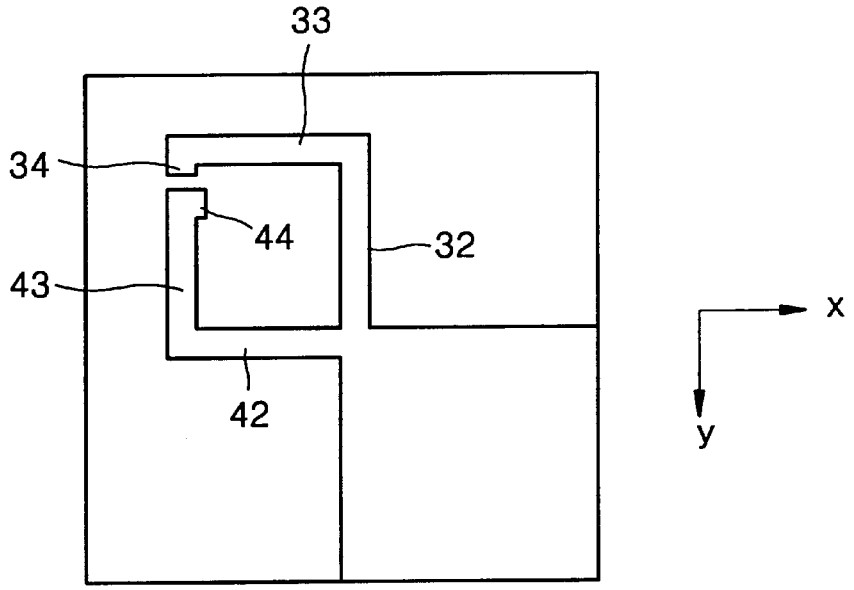
FIGS. 10 and 11 are plan views of a third embodiment of the planar antenna according to the present invention.
Figure 11:
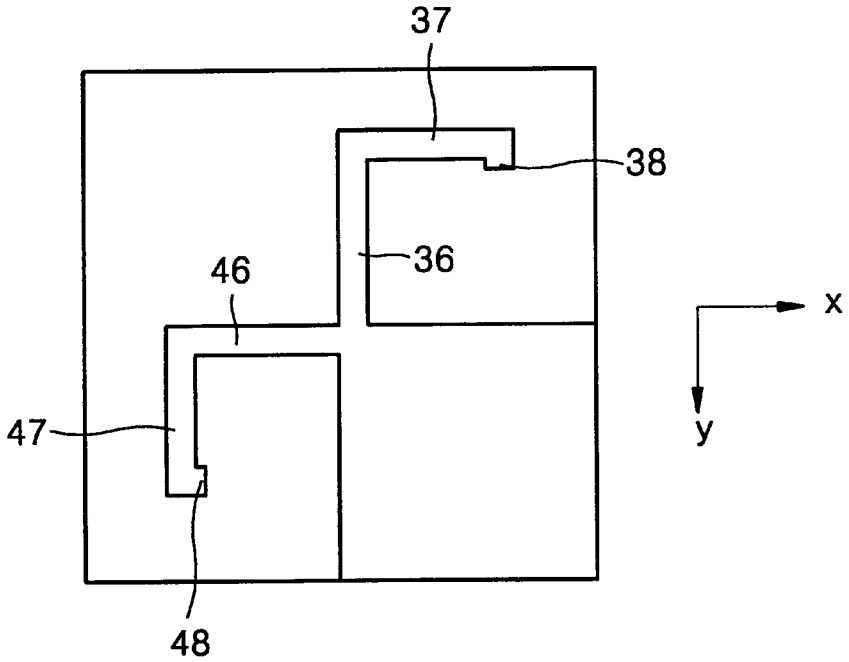

A third embodiment of the planar antenna according to the present invention is shown in FIGS. 10 and 11. As shown in FIGS. 10 and 11, the first upper and first lower radiation portions 33 and 37, respectively, have a first upper extension 34 and a first lower extension 38, and the second upper and second lower radiation portions 43 and 47, respectively, have a second upper extension 44 and a second lower extension 48, which extend a predetermined length perpendicular to an end of the corresponding radiation portion. The first upper and lower extensions 34 and 38, and the second upper and lower extensions 44 and 48, each may have a length of $\lambda/25$ to $\lambda/30$. The first upper and lower extensions 34 and 38, and the second upper and lower extensions 44 and 48, provide an advantage of increasing the efficiency of radiation of the antenna.

As previously described, the planar antenna according to the present invention can be manufactured in combination with a PCB. Also, the size of the planar antenna can be minimized by forming antenna units and a RF circuit module on the same plane. Thus, the planar antenna can be easily installed in products that need it.

Another advantage of the planar antenna according to the present invention is that a double-polarized-wave antenna, for example, capable of radiating both circular and elliptical polarized waves, can be realized. The planar antenna according to the present invention is suitable as the Bluetooth PICO Net (BPN) antenna with minimized interference from heterogeneous terminals or a server.

The planar antenna according to the present invention does not need a delay element in a RF circuit module, which is necessary to radiate circular polarized waves using conventional antennas, and thus the cost of the RF circuit module can be reduced, thereby lowering the manufacturing cost of the product.

While this invention has been particularly shown and described with reference to preferred embodiments thereof, it will be understood by those skilled in the art that various changes in form and details may be made thereto without departing from the spirit and scope of the invention as defined by the appended claims.

What is claimed is:

1. A planar antenna comprising:

a dielectric layer with a predetermined thickness;

a first ground layer formed on a top surface of the dielectric layer;

a second ground layer formed on a bottom surface of the dielectric layer, the first ground layer and the second ground layer corresponding to each other;

a first antenna unit which extends from a side of the first ground layer and a side of the second ground layer, the first antenna unit having a predetermined pattern which radiates a first polarized wave with an application of current;

a second antenna unit which extends from a side of the first ground layer and a side of the second ground layer, the second antenna unit having a predetermined pattern which radiates a second polarized wave orthogonal to the first polarized wave with the application of current; and a feeding stripline installed between the first and the second antenna units, in the dielectric layer, the feeding stripline applies current to the first and the second antenna units, wherein the first and the second polarized waves are operative to be separately radiated from the first and the second antenna units, respectively.

2. The planar antenna of claim 1, wherein the first antenna unit comprises:

a first upper radiation pattern having a first upper stub line which extends a length of $\lambda/4$ from an edge of the first ground layer, and a first upper radiation portion which radiates waves and extends from an end of the first upper stub line orthogonal to a longitudinal direction of the first upper stub line; and a first lower radiation pattern having a first lower stub line which extends a length of $\lambda/4$ from an edge of the second ground layer, corresponding to the first upper stub line, and a first lower radiation portion which radiates waves and extends from an end of the first lower stub line in an opposite direction to the first upper radiation portion.

3. The planar antenna of claim 2, wherein each of the first upper and the first lower radiation portions has a length of less than $\lambda/4$.

4. The planar antenna of claim 2, wherein the first upper radiation portion and the first lower radiation portion, respectively, include a first upper extension disposed at an end of the first upper radiation portion and a first lower extension disposed at an end of the first lower radiation portion, the first upper extension and the first lower extension, respectively, are parallel to the first upper stub line and the first lower stub line and extend a predetermined distance to be respectively closer to the first ground layer and the second ground layer.

5. The planar antenna of claim 4, wherein each of the first upper and the first lower extensions has a length of $\lambda/25$ to $\lambda/30$.

6. The planar antenna of claim 1, wherein the second antenna unit comprises:

a second upper radiation pattern having a second upper stub line which extends a length of $\lambda/4$ from an edge of the first ground layer, and a second upper radiation portion which radiates waves and extends from an end of the second upper stub line orthogonal to a longitudinal direction of the second upper stub line; and a second lower radiation pattern having a second lower stub line which extends a length of $\lambda/4$ from an edge of the second ground layer, corresponding to the second upper stub line, and a second lower radiation portion which radiates waves and extends from an end of the second lower stub line in an opposite direction to the second upper radiation portion.

7. The planar antenna of claim 6, wherein each of the second upper and the second lower radiation portions has a length of less than $\lambda/4$.

8. The planar antenna of claim 6, wherein the second upper radiation portion and the second lower radiation portion, respectively, include a second upper extension disposed at an end of the second upper radiation portion and a second lower extension disposed at an end of the second lower radiation portion, the second upper extension and the second lower extension, respectively, are parallel to the second upper stub line and the second lower stub line and extend a predetermined distance to be respectively closer to the first ground layer and the second ground layer.

9. The planar antenna of claim 8, wherein each of the second upper and the second lower extensions has a length of $\lambda/25$ to $\lambda/30$.

10. The planar antenna of claim 1, wherein the feeding stripline comprises:

a first branch and a second branch, which power the first and the second antenna units; and a feeding portion from which the first and the second branches diverge and which is disposed between the first and second ground layers, the feeding portion receives power from a predetermined radio frequency (RF) circuit module and transfers the received power to the first and the second branches.

11. The planar antenna of claim 10, wherein the first and the second branches are arranged perpendicular to each other on a common plane parallel to the first and the second ground layers.

12. The planar antenna of claim 10, wherein the feeding portion is located between a first position, which is on an extension of the first branch close to and perpendicular to the second branch, and a second position, which is on an extension of the second branch close to and perpendicular to the first branch.

13. The planar antenna of claim 12, wherein an angle between the first branch and the feeding portion, and an angle between the second branch and the feeding portion, are the same.

14. The planar antenna of claim 10, wherein the first and the second branches are patterned with a different length to cause a time delay between a generation of waves from the first and the second antenna units, thus generating waves with a phase difference of 90°.

15. The planar antenna of claim 1, wherein the dielectric layer has a first via hole for applying current through an end of a first branch of the feeding stripline to the first antenna unit, and a second via hole for applying current through an end of a second branch of the feeding stripline to the second antenna unit.

16. The planar antenna of claim 1, wherein the dielectric layer has at least one return via hole for returning a flow of current between the first and second ground layers.

17. The planar antenna of claim 15, wherein the first and the second via holes are filled with a conductive material.

18. The planar antenna of claim 16, wherein the return via hole is filled with a conductive material.

* * * * *